US008206882B2

(12) United States Patent
Koyama et al.

(10) Patent No.: US 8,206,882 B2
(45) Date of Patent: Jun. 26, 2012

(54) TONER

(75) Inventors: Mikio Koyama, Tokyo (JP); Kenji Hayashi, Tokyo (JP); Hiroaki Obata, Tokyo (JP); Noriyuki Kinpara, Tokyo (JP); Hiroshi Nagasawa, Tokyo (JP); Yasuhiko Muramatsu, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 255 days.

(21) Appl. No.: 12/743,386

(22) PCT Filed: Jul. 23, 2009

(86) PCT No.: PCT/JP2009/063182

§ 371 (c)(1),
(2), (4) Date: May 18, 2010

(87) PCT Pub. No.: WO2010/013635

PCT Pub. Date: Feb. 4, 2010

(65) Prior Publication Data

US 2010/0255415 A1 Oct. 7, 2010

(30) Foreign Application Priority Data

Jul. 28, 2008 (JP) ..... 2008-193289

(51) Int. Cl.
*G03G 9/08* (2006.01)

(52) U.S. Cl. ..... 430/108.21

(58) Field of Classification Search ..... 430/108.21
See application file for complete search history.

(56) References Cited

FOREIGN PATENT DOCUMENTS

| | | |
|---|---|---|
| JP | 2213854 | 8/1990 |
| JP | 2293861 | 12/1990 |
| JP | 2311874 | 12/1990 |
| JP | 511504 | 1/1993 |
| JP | 2005215255 | 8/2005 |
| WO | 2006131960 | 12/2006 |

*Primary Examiner* — Mark A Chapman
(74) *Attorney, Agent, or Firm* — Lucas & Mercanti, LLP

(57) ABSTRACT

The object aims to improve the reproducibility of color and the stability in density of a toner. Disclosed is a toner comprising at least a resin and a colorant, wherein the colorant comprises a compound represented by general formula (1) and a compound represented by general formula (2). [In general formula (1), $R_1$ to $R_8$ respectively denote a hydrogen atom, a halogen atom, an alkyl group, or an alkyl group containing a fluorine atom, provided that at least one of $R_1$ to $R_8$ denotes a chlorine atom]. [In general formula (2), $R_1$ to $R_4$ respectively denote a hydrogen atom, or an alkyl group having 1 to 4 carbon atoms; $R_5$ and $R_6$ respectively denote a hydrogen atom, or an alkyl group having 1 to 2 carbon atoms; $R_7$ denotes a hydrogen atom, or an alkyl group having 1 to 4 carbon atoms; m denotes a number of 1 or 2; $A^{n-}$ denotes a chlorine ion or a sulfonic acid compound ion; and n denotes a number of 1 or 2.

4 Claims, 1 Drawing Sheet

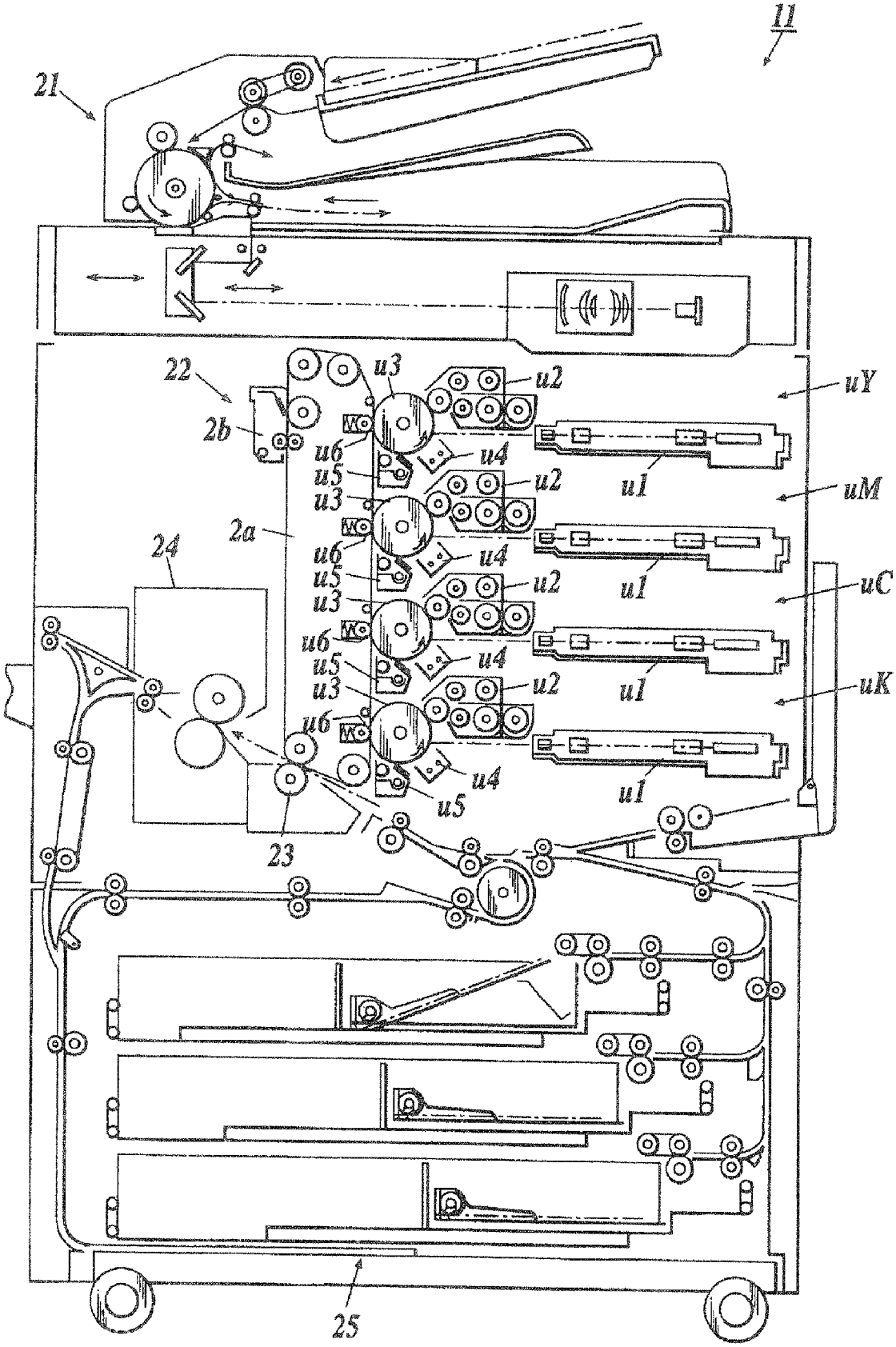
11
21
22
2b
2a
24
23
25
u1
u2
u3
u4
u5
u6
uY
uM
uC
uK

TONER

CROSS REFERENCE TO RELATED APPLICATION

This is a U.S. National Phase Application under 35U.S.C. 371 of International Application PCT/JP2009/063182, filed Jul. 23, 2009, which claims the priority of Japanese Application No. 2008-193289, filed Jul. 28, 2008, the entire content of both Applications are hereby incorporated by reference.

TECHNICAL FIELD

The present invention relates to toner.

BACKGROUND ART

Development of an image forming apparatus of an electrophotographic method has been advanced mainly as a copier or a printer used in an office and the like.

A color image forming apparatus in which a speed and image quality are high is also called a digital printer, and is useful for printing variable information such as direct mail and estimates. A lithographic plate is unnecessary, and accordingly, in particular for small-lot printing, the color image forming apparatus begins to be widespread as an alternative to an offset printer that has been a mainstream for commercial printing. In comparison with a usual color printer used in the office, in the color image forming apparatus, a turnover of consumables such as toner is high, and therefore, the respective enterprises mount original technologies on the color image forming apparatus, and new entries appear one after another.

In the printing industry, "RGB" conversion of entered data, that is, creation of data by R (red), G (green) and B (blue) has already become a standard, and under the present circumstances, a color reproduction range of the data to be handled is being shifted to a wider range.

However, in a color image forming method using four process colors (CMYK), which are cyan (C), magenta (M), yellow (Y) and black (K), hues are formed by subtractive color mixture. Accordingly, not only RGB data is subjected to color separation into a narrower color reproduction range of CMYK, but also muddiness occurs in the hues every time when a color is superimposed on another, and the color reproduction range of CMYK necessarily becomes narrower than that of RGB. Therefore, a difference in color reproducibility between the data and printed matter has become a problem.

In particular, with regard to a hue of blue violet (corresponding to B of RGB) expressed by two secondary colors of magenta and cyan, it has been difficult to reproduce a required color reproduction range, that is, a range of "B" in the entered data of "RGB". Meanwhile, in order to deal with the standard colors in the printing industry, which have been used heretofore, that is, JAPAN COLOR Standard which serves as criteria for unifying tones of the printer matter, it has also been necessary to strengthen color reproduction of "R".

Moreover, in a color electrophotographic method, a subject still remained in several thousand pieces of the entered data being printed free from density fluctuations from the start of printing to the end thereof. In the electrophotographic method, image development and transfer are performed by the toner in which an electrostatic latent image is subjected to triboelectric charging, and accordingly, the electrophotographic method is prone to be affected by variations of atmospheric humidity and a moisture amount contained in sheets, and it has been a subject to ensure more stability of the density than in offset printing (for example, refer to Japanese Patent Application Laid-Open Publication No. 2005-215255).

Moreover, the toner is made of thermoplastic resin having a fixed elastic modulus at the time of being heated and fused, and accordingly, it is difficult to control a thickness of a toner layer in an image portion so as to be no thicker than that of ink. Therefore, it is especially difficult to ensure lightness of an image of magenta toner, and it has been a technical subject to further improve reproduction of a tone of a flesh color or the like, in which an impression is changed by variations of the lightness.

Objects of the present invention include achieving the expansion of the color gamut, and improving the reproducibility of the tone and the stability of the density.

To achieve at least one of the above objects, provided is a toner, reflecting one aspect of the present invention, comprising at least a resin and a colorant, wherein the colorant comprises a compound represented by a following general formula (1) and a compound represented by a following general formula (2), wherein the general formula (1) is:

[Formula 1]

(1)

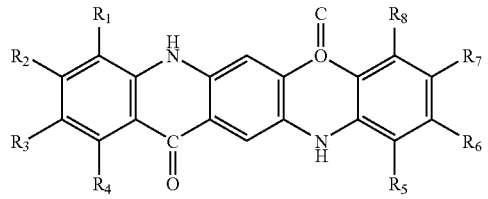

where $R_1$ to $R_8$ respectively denote any one of a hydrogen atom, a halogen atom, an alkyl group, and an alkyl group including a fluorine atom; and where at least one of $R_1$ to $R_8$ denotes a chlorine atom, and wherein the general formula (2) is:

[Formula 2]

(2)

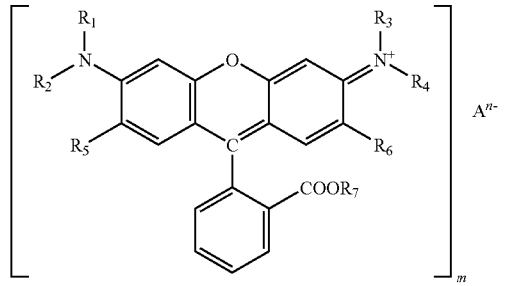

where $R_1$ to $R_4$ respectively denote a hydrogen atom, or an alkyl group having 1 to 4 carbon atoms; $R_5$ and $R_6$ respectively denote a hydrogen atom, or an alkyl group having 1 to 2 carbon atoms; $R_7$ denotes a hydrogen atom, or an alkyl group having 1 to 4 carbon atoms; m denotes the number of 1 or 2; $A^{n-}$ denotes a chlorine ion or a sulfonic acid compound ion; and n denotes the number of 1 or 2.

Further, provided is the toner, wherein in the compound represented by the general formula (1), at least one of $R_1$ to $R_4$ is a chlorine atom, and at least one of $R_5$ to $R_8$ is a chlorine atom.

Further, provided is the toner wherein the compound represented by the general formula (2) is subjected to a lake conversion by a lake species.

Further, provided is the toner, wherein the compound represented by the general formula (1) is included by a ratio of 20 to 100mass parts with respect to 100 mass parts of the compound represented by the general formula (2).

In accordance with the present invention, a wide color gamut is provided for blue, and color reproducibility in color tone of blue can be enhanced to a large extent. By the enhancement of the reproducibility of blue, the lightness of the image of the magenta toner is also enhanced, and the reproducibility of the flesh color can be enhanced. Moreover, by the expansion of the color gamut, it becomes possible to reproduce colors, which are displayed by the RGB mode, also on the printed matter with fidelity. Furthermore, even in the case of using the present invention for continuous printing, the density variations are reduced, and the stability of the density can also be enhanced.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein: FIGURE is a view showing an example of an image forming apparatus.

{Toner}

Toner according to the present invention comprises toner particles containing at least resin and colorant. According to needs, a release agent, a charge control agent and an extraneous additive can be added to the toner.

[Resin]

No particular limitations are imposed on the resin, however, as an example thereof, a polymer formed by polymerizing the following polymerizable monomers called vinyl-based monomers, may be cited. This polymer contains, as a constituent component, a polymer obtained by polymerizing at least one type of the polymerizable monomers, and is prepared by combining a single type of the vinyl-based monomers or plural types thereof.

Specific examples of the vinyl-based polymerizable monomer will be described below.

(1) Styrene or Styrene Derivatives

For example, styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octyl-styrene, p-n-nonylstyrene, p-n-decylstyrene, p-n-dodecylstyrene, and the like, may be cited.

(2) Methacrylate Ester Derivatives

For example, methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate, dimethylaminoethyl methacrylate, and the like, may be cited.

(3) Acrylate Ester Derivatives

For example, methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, phenyl acrylate, and the like, may be cited.

(4) Olefins

For example, ethylene, propylene, isobutylene, and the like, may be cited.

(5) Vinyl Esters

For example, vinyl propionate, vinyl acetate, vinyl benzoate, and the like, may be cited.

(6) Vinyl Ethers

For example, vinylmethylether, vinylethylether, and the like, may be cited.

(7) Vinyl Ketones

For example, vinylmethylketone, vinylethylketone, vinylhexylketone, and the like, may be cited.

(8) N-Vinyl compounds

For example, N-vinylcarbazole, N-vinylindole, N-vinylpyrrolidone, and the like, may be cited.

(9) Others

Besides the above, vinyl compounds such as vinylnaphthalene and vinylpyridine; acrylic acid or methacrylic acid derivatives such as acrylonitrile, methacrylonitrile and acrylamide; and the like, may be cited.

Moreover, as the vinyl-based polymerizable monomer that composes the resin usable for the toner according to the present invention, those having ionic leaving groups to be described below may also be used. For example, those having functional groups such as carboxylic groups, sulfonic groups and phosphoric groups on side chains of the monomers, may be cited. Specifically, as those having the carboxylic groups, acrylic acid, methacrylic acid, maleic acid, itaconic acid, cinnamic acid, fumaric acid, monoalkyl maleate ester, monoalkyl itaconate ester, and the like, may be cited. Moreover, as those having the sulfonic groups, styrene sulfonate, allyl sulfosuccinate, 2-acrylamide-2-methylpropane sulfonate, and the like, may be cited. As those having the phosphoric groups, acid phosphoxyethyl methacrylate, and the like, may be cited.

Moreover, it is also possible to prepare resin of a crosslinking structure by using multifunctional vinyls as a crosslinking agent. As examples of the multifunctional vinyls, divinylbenzene, ethyleneglycol dimethacrylate, ethyleneglycol diacrylate, diethyleneglycol dimethacrylate, diethyleneglycoldiacrylate, triethyleneglycol dimethacrylate, triethyleneglycol diacrylate, neopentylglycol dimethacrylate, neopentylglycol diacrylate, and the like, may be cited.

Moreover, as a type of the resin usable for the toner according to the present invention, polyester resin, polyester polyol resin, or the like, may be cited.

As a monomer of the polyester resin, there can be used alcohol and carboxylic acid, carboxylic anhydride, carboxylic ester, or the like.

Specifically, for example, as divalent alcohol components, an alkylene oxide adduct of bisphenol A, such as polyoxypropylene(2,2)-2,2-bis(4-hydroxyphenyl)propane, polyoxypropylene(3,3)-2,2-bis(4-hydroxyphenyl)propane, polyoxyethylene(2,0)-2,2-bis(4-hydroxyphenyl)propane, polyoxypropylene(2,0)-polyoxyethylene(2,0)-2,2-bis(4-hydroxyphenyl)propane, and polyoxypropylene(6)-2,2-bis(4-hydroxyphenyl)propane; ethylene glycol; diethylene glycol; trienthylene glycol; 1,2-propylene glycol; 1,3-propylene glycol; 1,4-butanediol; neopentyl glycol; 1,4-butenediol; 1,5-pentanediol; 1,6-hexanediol; 1,4-cyclohexane dimethanol; dipropylene glycol; polyethylene glycol; polypropylene glycol; polytetramethylene glycol; bisphenol A; hydrogenated bisphenol A; and the like, may be cited.

As trivalent or more alcohol components, for example, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene, and the like, may be cited.

As carboxylic acid components, aromatic dicarboxylic acids such as phthalic acid, isophthalic acid and terephthalic acid, or anhydrides thereof; alkyl dicarboxylic acids such as succinic acid, adipic acid, sebacic acid and azelaic acid, or anhydrides thereof; succinic acid replaced by an alkyl group with a carbon number of 6 to 12, or an anhydride thereof; and unsaturated dicarboxylic acids such as fumaric acid, maleic acid and citraconic acid, or anhydrides thereof, may be cited.

Among them, polyester resin formed by polycondensating a diol component and an acid component is preferable since the polyester resin imparts provides dielectric characteristics to the toner. Here, a bisphenol derivative represented by the following general formula (3) is used as the diol component, and as the acid component, used is a carboxylic acid component composed of a divalent or more carboxylic acid or an anhydride thereof, or of lower alkyl ester thereof. The carboxylic acid component includes, for example, fumaric acid, maleic acid, maleic anhydride, phthaiic acid, terephthalic acid, trimellitic acid, pyromellitic acid, and the like.

[Formula 3]

(3)

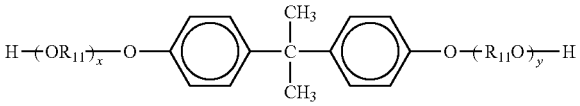

where $R_{11}$ denotes an ethylene group or a propylene group, x and y are individually integers of 1 or more, in which an average value of x and y is 2 to 10.

Moreover, as the multivalent (trivalent or more) carboxylic acid component for forming the polyester resin having crosslinked regions, for example, 1,2,4-benzenetricarboxylic acid, 1,2,5-benzenetricarboxylic acid, 1,2,4-naphthalenetricarboxylic acid, 2,5,7-naphthalenetricarboxylic acid, 1,2,4,5-benzenetetracarboxylic acid, and anhydrides and ester compounds of these, may be cited.

Furthermore, the polyester polyol resin is obtained by reacting the following main raw materials with one another. The main raw materials are: bisphenols (b1) represented by the following general formula (4); bisphenol-type epoxy resin (b2) represented by the following general formula (5); at least one selected from multivalent alcohol (b3) and a reactant (b4) of the multivalent alcohol and an acid anhydride; a compound (b5) containing, in each molecule, an active hydrogen group to be reacted with an epoxy group; and if necessary a crosslinking agent (b6).

[Formula 4]

(4)

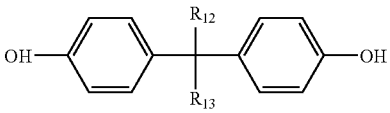

where $R_{11}$ and $R_{12}$ are hydrogen atoms, methyl groups, ethyl groups or phenyl groups, in which $R_{11}$ and $R_{12}$ may be the same or different.

[Formula 5]

(5)

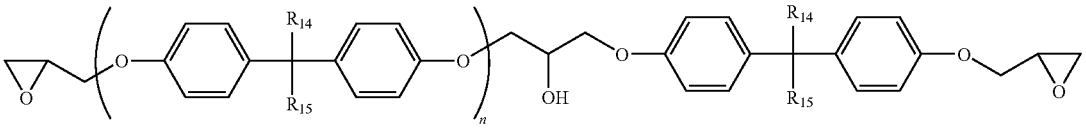

where $R_{13}$ and $R_{14}$ are hydrogen atoms, methyl groups, ethyl groups or phenyl groups, and n is an integer of 0 or more, in which $R_{13}$ and $R_{14}$ may be the same or different.

As specific examples of the bisphenols (b1) represented by the general formula (4), 2,2-bis(4-hydroxyphenyl)propane (popularly called bisphenol A), bis(4-hydroxyphenyl)methane (popularly called bisphenol F), 1,1-bis(4-hydroxyphenyl) ethane (popularly called bisphenol AD), 1-phenyl-1,1bis(4-hydroxyphenyl)methane, 1-phenyl-1,1bis(4-hydroxyphenyl) ethane, and the like, may be cited.

These bisphenols may be used alone, or may be used in combination of two or more types thereof.

As the bisphenol-type epoxy resin (b2) represented by the general formula (5), for example, so-called one-stage-process epoxy resin may be cited, which is produced from the bisphenols (b1) represented by the general formula (4) and epichlorohydrin, or two-stage-process epoxy resin as a polyaddition reaction product of the one-stage-process epoxy resin and the bisphenols (b1) ("Shin epokishi jushi (new epoxy resin)", written and edited by Hiroshi Kakiuchi, Shokodo Co., Ltd., Showa 60 (1985), p. 30).

Moreover, as the multivalent alcohols (b3) as one of the main raw materials, divalent alcohol such as aromatic diol, aliphatic diol, and alicyclic diol, and the like, and trivalent or tetravalent alcohol may be cited.

As the aromatic diol, a compound represented by the following formula (6) may be cited.

[Formula 6]

(6)

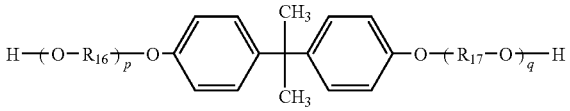

where $R_{15}$ and $R_{16}$ are ethylene groups or propylene groups, p and q are integers of 1 or more, in which the sum of p and q is 2 to 10, and $R_{15}$, and $R_{16}$ may be the same or different.

As specific examples of the aromatic diol as described above, polyoxyethylene-(2,0)-2,2-bis(4-hydroxyphenyl)propane, polyoxypropylene-(2,0)-2,2-bis(4-hydroxyphenyl) propane, polyoxypropylene-(1,2)-2,2-bis(4-hydroxyphenyl) propane, polyoxypropylene-(1,1)-2,2-bis(4-hydroxyphenyl) propane, polyoxypropylene-(2,2)-polyoxyethylene-(2,0)-2,2-bis(4-hydroxyphenyl)propane, polyoxypropylene-(6)-2,2-bis(4-hydroxyphenyl)propane, polyoxypropylene (3,3)-2,2-bis(4-hydroxyphenyl)propane, and the like, may be cited. Moreover, in the present invention, p-xylylene glycol and m-xylylene glycol can also be used as the aromatic diol.

As the aliphatic diol, for example, ethylene glycol, diethylene glycol, propylene glycol, triethylene glycol, tetramethylene glycol, pentamethylene glycol, neopentyl glycol, and the like, may be cited.

As the alicyclic diol, for example, dihydroxymethyl cyclohexane, hydrogeneated bisphenol A, and the like may be cited.

As the trivalent or tetravalent alcohol, for example, 1,2,3,6-hexanetetrol, 1,4-sorbitan, pentaerythritol, tripentaerythritol, 1,2,4-butanetriol, trimethylolethane, rimethylolpropane, 1,3,5-trihydroxymethylbenzene, and the like, may be cited.

Moreover, with regard to the reactant (b4) multivalent alcohol and acid anhydride, which is one of the main raw materials, as the acid anhydride for use in the reaction with the multivalent alcohol, for example, phthalic anhydride, trimellitic acid anhydride, pyromellitic acid anhydride, ethylene glycol bis trimellitate, glycerol tristrimellitate, maleic anhydride, tetrahydrophthalic anhydride, methyltetrahydrophthalic anhydride, endo-methylenetetrahydrophthalic anhydride, methylendo-methylenetetrahydrophthalic anhydride, methylbutenyltetrahydrophthalic anhydride, dodecenyl succinic anhydride, hexahydrophthalic anhydride, methylhexahydrophthalic anhydride, succinic anhydride, methyl cyclohexene dicarboxylic acid anhydride, an alkyl styrene-maleic anhydride copolymer, chlorendic acid anhydride, and polyazelaic acid anhydride, may be cited.

Usually under the presence of a catalyst, the reaction between the multivalent alcohols and the acid anhydride can be performed at 80° C. to 150° C. for a reaction time of 1 to 8 hours. This reaction between the multivalent alcohols and the acid anhydride may be performed simultaneously with a polyaddition reaction in production of resin to be described later, which is preferably used in the present invention, or may be performed before the polyaddition reaction. Since the acid anhydride functions as the crosslinking agent, and gelation thereof sometimes occurs depending on the case, it is preferable to perform the reaction concerned before the polyaddition reaction. As the catalyst for use in this reaction, for example, alkaline metal hydroxide such as sodium hydroxide, potassium hydroxide and lithium hydroxide; alkaline metal alcoholate such as sodium methylate; tertiary amine such as N,N-dimethylbenzylamine, triethylamine and pyridine; quaternary ammonium salt such as tetramethyl ammonium chloride and benzyltriethyl ammonium chloride; an organic phosphorous compound such as triphenylphosphine and triethylphosphine; alkaline metal salt such as lithium chloride and lithium bromide; Lewis acid such as boron trifluoride, aluminum chloride, tin tetrachloride, tin octylate and zinc benzoate; and the like, may be cited. A usage amount of the catalyst is an amount to achieve a concentration thereof usually ranging from 1 to 1000 ppm, and preferably ranging from 5 to 500 ppm with respect to an amount of the product. Moreover, in this reaction, a solvent may be used arbitrarily. In the case of using the solvent, preferably used are: aromatic hydrocarbons such as toluene, xylene and ethyl benzene; and ketones such as methyl isobutyl ketone and methyl ethyl ketone.

The compound (b5), which is one of the main raw materials, and contains, in each molecule, the active hydrogen group to be reacted with the epoxy group, is monovalent phenols, secondary amines, or monovalent carboxylic acids.

As the monovalent phenols, for example, phenol, cresol, isopropyl phenol, octyl phenol, nonyl phenol, dodecyl phenol, xylenol, p-cumyl phenol, α-naphthol, β-naphthol, and the like, may be cited.

As the secondary amines, for example, aliphatic secondary amine such as diethylamine, dipropylamine, dibutylamine, dipentylamine, didodecylamine, distearylamine, diethanolamine and diarylamine; aromatic ring-containing secondary amine such as N-methylaniline, N-methyl toluidine, N-methyl nitroaniline, diphenylamine, ditolylamine and benzyl dimethyl amine; and the like, may be cited.

As the monovalent carboxylic acids, for example, aliphatic carboxylic acid such as propionic acid, butyric acid, capric acid, caprylic acid, pelargonic acid and stearic acid; and aromatic ring-containing monovalent carboxylic acid such as benzoic acid, toluic acid, α-naphthoic acid, β-naphthoic acid and phenyl acetate, may be cited.

Moreover, as the crosslinking agent (b6) to be used according to needs, for example, there are used: polyamines such as aromatic polyamine and aliphatic polyamine; acid anhydride; a trivalent or more phenol compound; trivalent or more epoxy resin; and the like. As the polyamines, for example, diethylenetriamine, triethylenetriamine, iminobispropylamine, bis(hexamethylene)triamine, trimethylhexamethylenediamine, diethylaminopropylamine, metaxylylenediamine, metaphenylenediamine, diaminodiphenylmethane, diaminodiphenylsulfon and the like, may be cited.

[Colorant]

In the toner according to the present invention, the colorant contains a compound represented by the following general formula (1) and a compound represented by the following general formula (2). This colorant can be used as colorant of magenta.

[Formula 7]

(1)

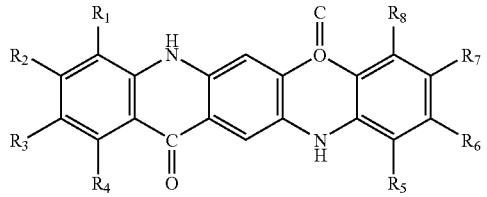

[where each of $R_1$ to $R_8$ denotes any one of a hydrogen atom, a halogen atom, an alkyl group and an alkyl group containing a fluorine atom, and at least one of $R_1$ to $R_8$ is a chlorine atom.]

[Formula 8]

(2)

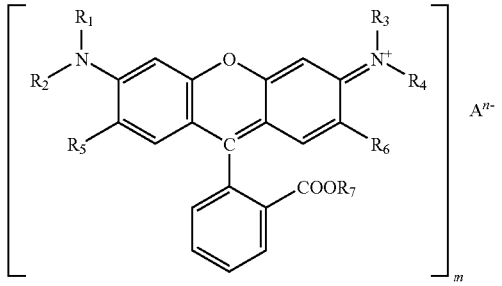

[where each of $R_1$ to $R_4$ denotes a hydrogen atom or an alkyl group with a carbon number of 1 to 4. Each of $R_5$ and $R_6$ denotes a hydrogen atom or an alkyl group with a carbon number of 1 and 2, $R_7$ denotes a hydrogen atom or an alkyl group with a carbon number of 1 to 4. m denotes 1 or 2, and $A^{n-}$ denotes a chlorine ion or a sulfonic acid compound ion, n denotes 1 or 2.]

With regard to a content ratio (mass ratio) of the compound represented by the foregoing general formula (1) and the compound represented by the foregoing general formula (2), it is preferable that a mass part of the compound represented by the general formula, (1) be 1 to 5 with respect to 5 mass parts of the compound represented by the general formula (2). In other words, it is preferable that the content ratio of the compound represented by the general formula (1) and the compound represented by the general formula (2) be 1:5 to 5:5.

Moreover, in the compound of the foregoing general formula (1), it is preferable that at least one of $R_1$ to $R_4$ be a chlorine atom, and that at least one of $R_5$ to $R_8$ be a chlorine atom.

Furthermore, the compound represented by the general formula (2) may be a compound converted into lake by lake species. The lake species refer to oxides for use in such lake conversion. As the lake species, for example, an inorganic molybdic acid compound such as phosphomolybdic acid, silicomolybdic acid and phosphotungstomolybdic acid, may be cited. By the lake conversion, lightfastness of the compound can be enhanced.

The compound represented by the general formula (2) of the present invention is defined as magenta colorant that plays a main role for enriching reproduction of blue. Meanwhile, the compound represented by the general formula (1) is added to the compound represented by the general formula (2) in an auxiliary manner, whereby synergy is generated, and sharpens red of a type called scarlet. For example, when an advertisement effect is desired to be emphasized, colors of red and magenta, in each of which lightness and clearness are high, are obtained. Moreover, color reproducibility of the red range emerges, which exceeds that of the above-mentioned JAPAN COLOR Standard defining the printing standard colors.

[Colorant of Yellow Toner]

Yellow toner to be used in combination with the magenta toner according to the present invention contains similar binding resin to that of the magenta toner. From a viewpoint of reproduction of red and green and stability of charge to toner, preferable yellow colorant is C.I. Pigment 74, C.I. Pigment 3, C.I. Pigment 35, C.I. Pigment 65, C.I. Pigment 95, C.I. Pigment 98, C.I. Pigment 111, C.I. Pigment 139, C.I. Solvent Yellow 94, and C.I. Solvent Yellow 162. Among them, C.I. Pigment 74 is particularly preferable.

[Colorant of Cyan Toner]

Cyan colorant to be preferably used in the present invention is silicon phthalocyanine represented by the following general formula (7).

[Formula 9]

(7)

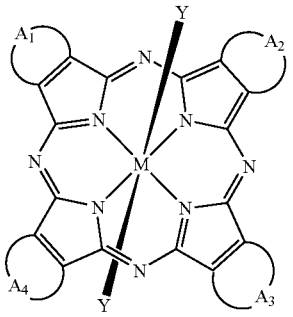

[where M denotes silicon atom (Si), and A denotes atom groups which compose benzene rings. However, A may be replaced by a chlorine atom, a nitro group, a cyano group or a perfluoro group. Moreover, Y individually denotes any one of a hydroxyl group, chlorine, an alkoxy group with a carbon number of 1 to 22, and a compound represented by the following general formula (8).

[Formula 10]

(8)

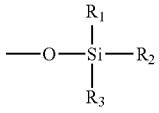

[where each of $R_1$ $R_2$ and $R_3$ denotes an alkyl group with a carbon number of 1 to 6.]

As illustrative compounds of the silicon phthalocyanine represented by the general formula (7), compounds represented in the following formulae (9) to (14), may be cited, where n denotes normal aliphatic hydrocarbons (without braches), and i denotes isomers (with braches).

[Formula 11]

(9)

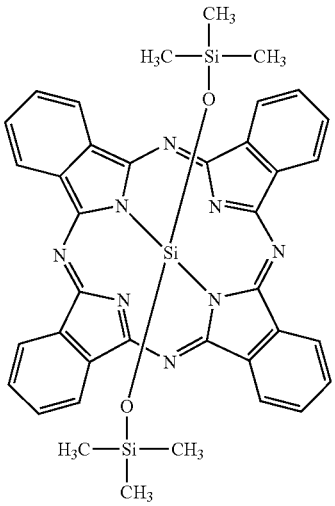

(10)

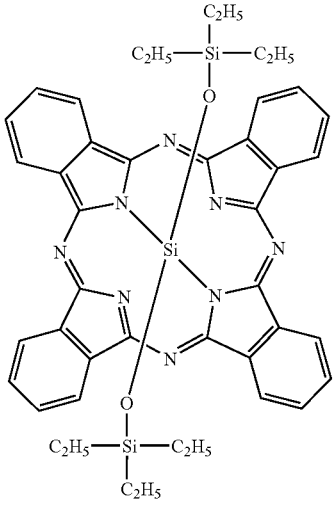

-continued (11)

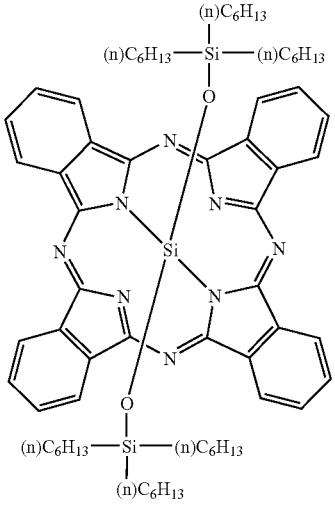

(12)

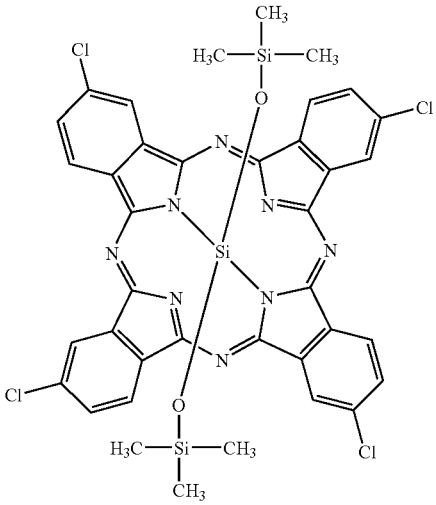

(13)

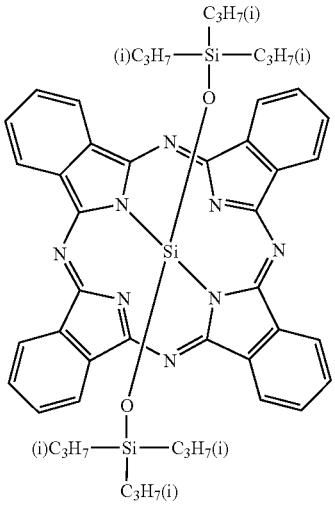

-continued (14)

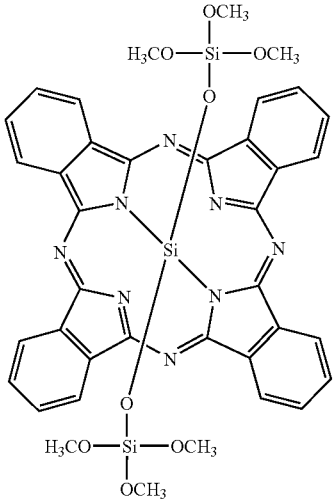

[Release Agent]

As the release agent usable for the toner according to the present invention, publicly known waxes as shown below may be cited.

(1) Polyolefin-Based Wax

For example, polyethylene wax, polypropylene wax and the like, may be cited.

(2) Long-Chain Hydrocarbon-Based Wax

For example, paraffin wax, Sasol wax and the like, may be cited.

(3) Dialkyl Ketone-Based Wax

For example, distearyl ketone and the like, may be cited.

(4) Amide-Based Wax

For example, ethylenediamine dibehenylamide, trimellitic acid tristearylamide, and the like, may be cited.

Ester-Based Wax

Carnauba wax, montan wax, trimethylolpropane tribehenate, pentaerythritol tetramyristate, pentaerythritol tetrastearate, pentaerythritol tetrabehenate, pentaerythritol diacetate dibehenate, glycerin tribehenate, 1,18-octadecanediol distearate, trimellitic acid tristearyl, distearyl maleate, and the like, may be cited.

A melting point of the wax is usually 40 to 125° C., preferably 50 to 120° C., more preferably 60 to 90° C. By setting the melting point within the above-described range, heat-resistant storage properties of the toner are ensured. In addition, even in the case of performing the fixing at a low temperature, a stable toner image can be formed without causing cold offset. Moreover, a wax content in the toner is preferably 1 mass % to 30 mass %, more preferably, 5 mass % to 20 mass %.

[Extraneous Additive]

By addition of the extraneous additive, fluidity and electrification characteristics of the toner are improved, and moreover, enhancement of a cleaning capability is realized. A type of the extraneous additive is not particularly limited, and for example, inorganic microparticles, organic microparticles, lubricant and the like, may be cited.

As the inorganic microparticles, it is possible to use publicly known ones with an average primary particle diameter approximately ranging from 4 to 800 nm. For example, microparticles of silica, titania, alumina, strontium titanate, and the like, may be cited as preferable ones. Moreover, it is also possible to use the inorganic microparticles subjected to hydrophobic treatment according to needs.

As specific examples of the silica microparticles, for example, commercial products R-805, R-976, R-974, R-972, R-812 and R-809 made by Nippon Aerosil Co., Ltd.; HVK-2150 and H-200, which are made by Hoechst AG; commercial products TS-720, TS-530, TS-610, H-5, MS-5 made by Cabot Corporation; and the like, may be cited.

As the titania microparticles, for example, commercial articles T-805 and T-604 made by Nippon Aerosil Co., Ltd.; commercial products MT-100S, MT-100B, MT-500BS, MT-600, MT-600SS and JA-1 made by Tayca Corporation; commercial products TA-300S1, TA-500, TAF-130, TAF-510 and TAF-510T made by Fuji Titanium Industry Co., Ltd.; commercial products IT-S, IT-OA, IT-OB, IT-OC made by Idemitsu Kosan Co., Ltd; and the like, may be cited.

As the alumina microparticles, for example, commercial products RFY-C and C-604 made by Nippon Aerosil Co., Ltd.; a commercial product TTO-55 made by Ishihara Sangyo Kaisha Ltd.; and the like, may be cited.

As the organic microparticles, spherical ones can be used, in which a number average primary particle diameter approximately ranges from 10 to 2000 nm. Specifically, monopolymers of styrene, methyl methacrylate and the like and copolymers of these can be used.

The lubricant can be used for further enhancing the cleaning capability and transfer properties. As the lubricant, metal salt of higher fatty acid, such as the following salts may be cited, for example: stearates of zinc, aluminum, copper, magnesium, calcium and the like; oleates of zinc, manganese, iron, copper, magnesium and the like; palmitates of zinc, copper, magnesium, calcium and the like, linoleates of zinc, calcium and the like; and ricinoleates of zinc, calcium and the like.

It is preferable that a loading of each of the extraneous additives be 0.1 to 10.0 mass % with respect to the entire toner. Moreover, as an adding method of the extraneous additives, methods using a variety of publicly known mixing devices such as a turbular mixer, a Henschel mixer, a Nauta mixer and a V-type mixer, may be cited.

{Production Method of Toner}

The toner according to the present invention can be prepared by the conventional production method of the toner. With regard to the conventional production method of the toner, it is possible to prepare the toner by applying a polymerized toner production method (for example, emulsion association method, suspension polymerization method, polyester extension method, and the like) in which particles of the toner are formed while polymerizing polymeric monomers and simultaneously controlling a shape and size of the monomers, as well as a pulverization method in which the toner is prepared by being subjected to kneading, pulverization and classification. Moreover, a core/shell method may also be adopted, in which. the toner is composed of cores and shells, and the toner is encapsulated.

For example, in the case where the toner production method is the pulverization method, the method includes the following steps.

(1) Preparation of colorant dispersant (2) Kneading/pulverization of materials (resin, colorant dispersant, release agent, extraneous additive and the like) composing the toner Note that, in the case of producing the toner according to the present invention by the pulverization method, from a viewpoint of enhancing dispersibility of the colorant, it is preferable to prepare the toner in a state where a temperature of kneaded matter is maintained from equal to or higher than a softening point of the resin to equal to or lower than 130° C., at the point of time of ejecting the kneaded matter, that is, before cooling the kneaded matter.

Moreover, in the case where the toner production method is the emulsion association method, the method includes the following steps.

(1) Preparation of colorant dispersant (2) Polymerization of resin particles (3) Salting out/fusion of resin particles and colorant particles (4) Filtration/washing (5) Extraneous treatment Note that, from the viewpoint of enhancing the dispersibility of the colorant, in the emulsion association method and the suspension polymerization method, it is preferable to provide the step of polymerizing the polymeric monomers in an aqueous medium after the colorant of the present invention is dissolved or dispersed into the polymeric monomers. In the solution suspension method and the polyester extension method, the colorant of the present invention can be introduced into the toner particles by providing the step of dissolving the colorant of the present invention into a solution of resin such as methyl ethyl ketone.

In the case where the toner production method is the core/shell method, the method includes the following steps.

(1) Preparation of colorant dispersant (2) Formation of core particles (3) Formation of shell layer (4) Filtration/washing (5) Extraneous treatment The toner according to the present invention can be used as a nonmagnetic monocomponent developer composed only of toner, and can also be used as a binary developer composed of a carrier and toner.

In the case of using the toner as the nonmagnetic monocomponent developer, the toner is charged by being slid and pressed on a charging member and a development roller surface at the time of image formation. Such image formation by a nonmagnetic monocomponent development method can simplify a structure of a development device, and accordingly, has an advantage that the entire image forming apparatus can be made compact. Hence, when the toner according to the present invention is used as the nonmagnetic monocomponent developer, full-color printing compact and excellent in color reproducibility is enabled even under an operational environment where a space is restricted.

In the case of using the toner as the binary developer, high-speed full-color printing is possible by using a tandem image forming apparatus to be described later. Moreover, by selecting the resin and the wax, which compose the toner, full-color printing is also possible, which copes with so-called low-temperature fixing in which a sheet temperature at the time of fixing is approximately 100° C.

Publicly known ones can be used as a carrier that is magnetic particles to be used when the toner is used as the binary developer. For example, the carrier is metal such as iron, ferrite and magnetite, an alloy of these metals and metal such as aluminum and lead. Among them, ferrite particles are preferable. A volume average particle diameter of the carrier is preferably 15 to 100 μm, more preferably 25 to 80 μm.

{Image Forming Method}

A description will be given for an image forming method and an image forming apparatus, which use the toner according to the present invention.

Here, a description will be made of an image forming method and an image forming apparatus in the case of using the toner according to the present invention as the binary developer with reference to FIG. 1. FIG. 1 shows an example of an image forming apparatus 11 that performs the image formation by using the toner according to the present invention. This image forming apparatus 11 is one called a tandem color image forming apparatus.

As shown in FIG. 1, an image reading device 21 is provided on an upper part of the main body of the image forming apparatus 11.

Moreover, the image forming apparatus 11 includes units uY, uM, uC and uK, which perform exposure and development, so as to correspond to the colors of Y, M, C and K toners, respectively. Each of the units uY, uM, uC and uK includes an exposure device u1, a development device u2, a photosensitive body u3, a charging unit u4, a cleaning unit u5, and a primary transfer roller u6. The primary transfer roller u6 is brought into press contact with the photosensitive body u3.

Moreover, the image forming apparatus 11 includes an intermediate transfer unit 22, a secondary transfer roller 23, a fixing device 24, and a sheet feed unit 25. The intermediate transfer unit 22 includes an intermediate belt 2*a* that is wound around a plurality of rollers and supported thereby so as to be rotatable, and a cleaning unit 2*b*. The secondary transfer roller 23 is brought into press contact with the intermediate belt 2*a*.

At the time of the image formation, when the photosensitive body u3 is charged by the charging unit u4, the photosensitive body u3 is exposed by the exposure device ul, and an electrostatic latent image that is based on an image signal is formed on the photosensitive body u3. Subsequently, when the development is performed by the development device u2, and a toner image is formed in such a manner that the toner is adhered onto the photosensitive body u3, the toner image concerned is transferred to the intermediate belt 2*a* by rotation of the photosensitive body u3 and an action of the primary transfer roller u6. The units uY, uM, uC and uK of the respective colors sequentially repeat these steps of the exposure, the development and the transfer in synchronization with the rotation of the intermediate belt 2*a*, whereby the toner images of the respective colors are superimposed on the intermediate transfer belt 2*a*, and a color image is formed.

Meanwhile, when a sheet is conveyed from the sheet feed unit 25, and the sheet is conveyed to a position of the secondary transfer roller 23, the color image is transferred in a lump onto the sheet from the intermediate belt 2*a* by a function of the secondary transfer roller 23. Thereafter, the sheet is transferred to the fixing device 24, and is pressurized and heated, whereby the color image is fixed onto the sheet. Finally, the sheet is discharged to a tray provided outside. In such a way, the image is formed. After the image formation is ended, the toner remaining on the photosensitive bodies u3 and the intermediate belt 2*a* is removed by the cleaning units u5 and 22.

Examples

A specific description will be made below of the embodiment of the present invention by listing examples; however, the present invention is not limited to these examples.

Particle diameters measured in examples and comparative examples, which will be described below, are median diameters as volume criteria. The median diameters are those measured under the following measurement conditions by using "MICROTRAC UPA150" (made by Honewell International Inc.).

[Measurement Conditions]

Refractive index of sample: 1.59

Specific gravity of samples (in conversion to spherical particles): 1.05

Refractive index of solvent: 1.33

Viscosity of solvent: 0.797 (30° C.), 1.002 (20° C.)

Zero adjustment: performed by pouring ion exchange water into measurement cell

Preparation of Toners According to Examples and Comparative Examples

1. Preparation of Magenta Colorant Dispersion (1) Preparation of Magenta Colorant Dispersion MB1

11.5 mass parts of n-dodecyl sodium sulfate was added to 160 mass parts of ion exchange water, followed by stirring and dissolution, whereby a solution was prepared. While continuing to stir the solution concerned, the following compound as a colorant component of magenta was gradually added into the solution.

Compound A11: 7.1 mass parts

Compound B33: 17.9 mass parts

The compound A11 is a compound represented by the general formula (1), and $R_1$ to $R_8$ in the general formula (1) of the compound A11 are shown in Table 1 to be described below. Moreover, the compound B33 is a compound represented by the general formula (2), and $R_1$ to $R_7$, m and $A^{n-}$ in the general formula (2) of the compound B33 are shown in Table 2 to be described below.

TABLE 1

| COMPOUND OF GENERAL FORMULA (1) | $R_1$ | $R_2$ | $R_3$ | $R_4$ | $R_5$ | $R_6$ | $R_7$ | $R_8$ |
|---|---|---|---|---|---|---|---|---|
| A11 | H | H | Cl | H | H | H | Cl | H |
| A12 | Cl | H | H | H | Cl | H | H | H |
| A13 | H | Cl | H | H | H | Cl | H | H |
| A14 | H | H | H | Cl | H | H | H | Cl |
| A15 | H | Cl | H | H | Cl | H | H | Cl |
| A16 | H | $CF_3$ | Cl | H | H | Cl | $CF_3$ | H |
| A21 | H | H | H | H | H | H | H | H |
| A22 | H | H | $CH_3$ | H | H | H | $CH_3$ | H |

TABLE 2

| COMPOUND OF GENERAL FORMULA (2) | $R_1$ | $R_2$ | $R_3$ | $R_4$ | $R_5$ | $R_6$ | $R_7$ | m | $A^{n-}$ | LAKE SPECIES |
|---|---|---|---|---|---|---|---|---|---|---|
| B31 | $CH_3$ | $CH_3$ | $CH_3$ | $CH_3$ | H | H | H | 1 | Cl | NONE |
| B32 | $CH_3$ | $CH_3$ | $CH_3$ | $CH_3$ | H | H | H | 1 | NONE | NONE |
| B33 | $CH_3CH_2$ | H | $CH_3CH_2$ | H | $CH_3$ | $CH_3$ | $CH_3$ | 1 | Cl | PHOSPHOTUNGSTOMOLYBDIC ACID |
| B34 | $CH_3CH_2$ | H | $CH_3CH_2$ | H | $CH_3$ | $CH_3$ | $CH_3$ | 1 | Cl | PHOSPHOMOLYBDIC ACID |
| B35 | $CH_3CH_2$ | H | $CH_3CH_2$ | H | $CH_3$ | $CH_3$ | $CH_3$ | 1 | Cl | SILICOMOLYBDIC ACID |
| B36 | $CH_3CH_2$ | $CH_3CH_2$ | $CH_3CH_2$ | $CH_3CH_2$ | H | H | $CH_3$ | 1 | DBS | NONE |
| B37 | $CH_3CH_2$ | $CH_3CH_2$ | $CH_3CH_2$ | $CH_3CH_2$ | H | H | $CH_3CH_2$ | 2 | DNDS | NONE |

Note that, in Table 2, DBS denotes dodecyl benzene sulfonic acid ions, and DNS denotes dodecyl naphthalene disulfonic acid ions.

Subsequently, the obtained solution was subjected to dispersion treatment by using a stirring device "Clearmix W-Motion CLM-0.8" (made by M Technique Co., Ltd.), whereby a dispersion MB1 of magenta colorant particles in which the median diameter as the volume criterion was 142 nm was prepared.

(2) Preparation of Magenta Colorant Dispersions MB2 to MB19

Magenta colorant dispersions MB2 to MB19 were prepared in a similar procedure to that of the preparation of the magenta colorant dispersion MB1 except that the type and loading of the compound for the magenta colorant component were changed as shown in Table 3 to be described below. The respective compounds A11 to A16, A21 and A22 shown in Table 3 are compounds represented by the general formula (1), and $R_1$ to $R_8$ in the general formula (1) of each of the compounds A11 to A16, A21 and A22 are as shown in Table 1 described. above. Moreover, the respective compounds B31 to B37 are compounds represented by the general formula (2), and $R_1$ to R7, m and $A^{n-}$ in the general formula (2) of each of the compounds 331 to B37 are as shown in Table 2 described above.

$(OCH_2CH_2)_2SO_3Na$ was dissolved into 3040 mass parts of ion exchange water was poured into a reaction container attached with a stirring device, a temperature sensor, a cooling pipe and a nitrogen introducing device. Then, an inner temperature of the reaction container was raised to 80° C. while stirring the surfactant solution at a stirring speed. of 230 rpm under a nitrogen flow.

To this surfactant solution, there was added an initiator solution in which 10 mass parts of a polymerization initiator (potassium. persulfate: KPS) was dissolved into 400 mass parts of ion exchange water. Then, after a temperature of the obtained solution was set at 75° C., a monomer mixed solution composed of the following compounds was dropped thereonto for 1 hour.

Styrene: 532 mass parts n-butyl acrylate: 200 mass parts

Methacrylic acid: 68 mass parts n-octyl mercaptan: 16.4 mass parts

After the monomer mixed solution was dropped, this system was heated and stirred at 75° C. for 2 hours, and was thereby subjected to polymerization (this is referred to as first-stage polymerization). In such a way, resin particles j1 were prepared.

TABLE 3

| MAGENTA TONER | MAGENTA COLORANT DISPERSION | COMPOUND OF GENERAL FORMULA (1) COMPOUND | LOADING (MASS PART) | COMPOUND OF GENERAL FORMULA (2) COMPOUND | LOADING (MASS PART) | COMPOUND OF GENERAL FORMULA (1) COMPOUND | LOADING (MASS PART) | CONTENT RATIO |
|---|---|---|---|---|---|---|---|---|
| M1 | MB1 | A11 | 7.1 | B33 | 17.9 | NONE | 0 | 2:5:0 |
| M2 | MB2 | A12 | 7.1 | B33 | 17.9 | NONE | 0 | 2:5:0 |
| M3 | MB3 | A13 | 7.1 | B33 | 17.9 | NONE | 0 | 2:5:0 |
| M4 | MB4 | A14 | 7.1 | B33 | 17.9 | NONE | 0 | 2:5:0 |
| M5 | MB5 | A15 | 7.1 | B33 | 17.9 | NONE | 0 | 2:5:0 |
| M6 | MB6 | A16 | 7.1 | B33 | 17.9 | NONE | 0 | 2:5:0 |
| M7 | MB7 | A13 | 7.1 | B31 | 17.9 | NONE | 0 | 2:5:0 |
| M8 | MB8 | A13 | 7.1 | B32 | 17.9 | NONE | 0 | 2:5:0 |
| M9 | MB9 | A13 | 7.1 | B34 | 17.9 | NONE | 0 | 2:5:0 |
| M10 | MB10 | A13 | 7.1 | B35 | 17.9 | NONE | 0 | 2:5:0 |
| M11 | MB11 | A13 | 7.1 | B36 | 17.9 | NONE | 0 | 2:5:0 |
| M12 | MB12 | A13 | 7.1 | B37 | 17.9 | NONE | 0 | 2:5:0 |
| M13 | MB13 | A12 | 3.6 | B33 | 20.8 | A21 | 3.6 | 1:5:1 |
| M14 | MB14 | A12 | 3.6 | B33 | 20.8 | A22 | 3.6 | 1:5:1 |
| M15 | MB15 | A11 | 7.1 | B34 | 17.9 | NONE | 0 | 2:5:0 |
| M16 | MB16 | A11 | 7.1 | B35 | 17.9 | NONE | 0 | 2:5:0 |
| M17 | MB17 | A13 | 4.2 | B33 | 20.8 | NONE | 0 | 1:5:0 |
| M18 | MB18 | A13 | 12.5 | B33 | 12.5 | NONE | 0 | 5:5:0 |
| M19 | MB19 | A13 | 13.6 | B33 | 11.4 | NONE | 0 | 6:5:0 |
| L1 | LB1 | NONE | 0 | B33 | 17.9 | A22 | 7.1 | 0:5:2 |
| L2 | LB2 | A13 | 25 | NONE | 0 | A22 | 0 | 25:0:22 |

As shown in Table 3, each of the magenta colorant dispersions MB1 to MB19 at least contains one of the compounds A11 to A16 and one of the compounds B31 to B37. Moreover, each of the magenta colorant dispersions MB13 and MB14 at least contains one of the compounds A21 and A22. Table 3 shows content ratios (mass ratios) of the compounds A11 to A16, the compounds B31 to B37 and the compounds A21 and A22 in the respective magenta colorant dispersions MB1 to MB19.

2. Preparation of Magenta Toner According to Examples (1) Preparation of Magenta Toner M1 (Core/Shell Method)

i) Preparation of Core-Forming Resin Particles i-1) First-stage polymerization

A surfactant solution in which 4 mass parts of anionic surfactant represented by a structural formula $C_{10}H_{21}$ i-2) Second-stage polymerization (formation of intermediate layer)

The following compounds were poured into a flask attached with a stirring device, and a monomer mixed solution was prepared.

Styrene: 101.1 mass parts n-butyl acrylate: 62.2 mass parts

Methacrylic acid.: 12.3 mass parts n-octyl mercaptan: 1.75 mass parts

After the following release agent was added to the above-described monomer mixed solution, the obtained solution was heated to 80° C. to be dissolved, whereby a monomer mixed solution was prepared.

Paraffin wax "HNP-57" (made by Nippon Seiro Co., Ltd.): 93.8 mass parts

Meanwhile, a surfactant solution, in which 3 mass parts of the anionic surfactant used in the first-stage polymerization was dissolved into 1560 mass parts of ion exchange water was heated to 80° C., and to this surfactant solution, there was added 32.8 mass parts of a dispersion of the above-mentioned resin particles j1 in conversion to solid matter. After such addition, a monomer solution into which the above-described release agent was dissolved was mixed with and dispersed into the obtained solution for 8 hours by a mechanical disperser "Clearmix" (made by M Technique Co., Ltd.) having a circulation passage, whereby a dispersion containing emulsion particles having a dispersed particle diameter of 340 nm was prepared.

Subsequently, to this dispersion, there was added an initiator solution in which 6 mass parts of potassium persulfate was dissolved into 200 mass parts of ion exchange water, and this system was stirred at 80° C. for 3 hours, and was thereby subjected to polymerization (second-stage polymerization). In such a way, a dispersion of resin particles j2 was obtained.

3) Third-stage polymerization (formation of outer layer)

Into the dispersion of the resin particles j2 obtained as described above, an initiator solution was added, in which 5.45 mass parts of potassium persulfate was dissolved into 220 mass parts of ion exchange water, and then, under a temperature condition of 80° C., a monomer mixed solution composed of the following compounds was dropped thereonto for 1 hour.

Styrene: 293.8 mass parts n-butyl acrylate: 154.1 mass parts n-octyl mercaptan: 7.08 mass parts After the drop of the monomer mixed solution was ended, this system was heated and stirred for 2 hours, and was thereby subjected to polymerization (third-stage polymerization), followed by cooling to 28° C. In such a way, core-forming resin particles J were prepared.

A glass transition temperature Tg of the core-forming resin particles J prepared by the third-stage polymerization was 28.1° C.

Measurement of the glass transition temperature can be performed by using the DSC-7 differential scanning calorimeter (made by PerkinElmer Co., Ltd.) and the TAC7/DX thermal analyzer controller (made by PerkinElmer Co., Ltd.). With regard to a measurement procedure, 4.5 to 5.0 mg the sample was precisely weighed to two decimal places, was enveloped into an aluminum-made pan (KIT NO. 0219-0041), and was set in the DSC-7 sample holder. As a reference, a vacant aluminum-made pan was used. The measurement was performed by Heat-Cool-Heat temperature control under conditions where a measurement temperature was 0 to 200° C., a rate of temperature increase was 10° C./min, and a rate of temperature decrease was 10° C./min. Then, analysis was performed based on data at the second Heat. With regard to the glass transition temperature, an extension of a base line before a rise of the first endothermic peak was drawn, a tangential line indicating the maximum inclination. between a rising portion of the first peak and a vertex of the peak was drawn, and an intersection therebetween was obtained as the glass transition temperature.

ii) Formation of core particles

The following materials were poured into a reaction container attached with a temperature sensor, a cooling pipe, a nitrogen introducing device and a stirring device, followed by stirring.

Dispersion of core-forming resin particles J (in conversion to solid matter): 420.7 mass parts Ion exchange water: 900 mass parts Magenta colorant dispersion MB1: 200 mass parts After a temperature in the container was adjusted at 30° C., an aqueous sodium hydroxide solution with 5 moles/l was added to this solution, whereby pH thereof was adjusted at 8 to 11.

Subsequently, while stirring the above-described prepared solution, an aqueous solution in which 2 mass parts of magnesium chloride 6-hydrate was dissolved into 1000 mass parts of ion exchange water was added thereto at 30° C. for 10 minutes. After the obtained mixture (system) was left standing for 3 minutes, a temperature rise thereof was started, and this system was raised in temperature to 65° C. for 60 minutes. In this state, a particle diameter of associated particles was measured by "Call Counter TA-II" (made by Beckman Coulter, Inc.), and at the point of time when the median diameter (D50) as the volume criterion became 5.5 μm, an aqueous solution in which 40.2 mass part of sodium chloride was dissolved into 1000 mass part of ion exchange water was added to the system, and particle growth was stopped. Moreover, for aging treatment, the obtained mixture liquid was heated and stirred at 70° C. for 1 hour, whereby fusion of the particles was continued, and core particles were formed. When circularity of the obtained core particles was measured by "FPIA-2100" (made by Sysmex Corporation), average circularity was 0.912.

iii) Preparation of shell resin particles

Polymerization reaction treatment and post-reaction treatment were performed in a similar procedure to that of the preparation of the core-forming resin particles J except for replacing the monomer mixed solution used in the first-stage polymerization with a monomer mixed solution in which compounds and loadings thereof are as follows.

Styrene: 624 mass parts 2-ethylhexyl acrylate: 120 mass parts

Methacrylic acid: 56 mass parts n-octyl mercaptan: 16.4 mass parts

A glass transition temperature (Tg) of the shell resin particles were 62.6° C.

iv) Formation of shell layer

Subsequently, 96 mass parts (in conversion to solid matter) of a dispersion of the shell resin particles prepared as described above were added at 65° C., and further, an aqueous solution in which 2 mass parts of magnesium chloride 6-hydrate was dissolved into 1000 mass parts of ion exchange water was added thereto for 10 minutes. After such addition, the mixed solution was raised in temperature to 70° C. (shell conversion temperature), and was continued to be stirred for 1 hour, and the shell resin particles were fused onto the surfaces of core particles. The shell layers were formed on the core particles in such a manner that aging treatment was performed therefor at 75° C. for 20 minutes.

Here, 40.2 mass parts of sodium chloride were added to the shell layers and the core particles, and were cooled down to 30° C. at a rate of 6° C./min. Thereafter, the mixture was filtered, and was repeatedly washed by ion exchange water of 45° C. Thereafter, the mixture was dried by hot air of 40° C., whereby toner particles in which the shell layers were provided on the surfaces of the cores were prepared.

v) Extraneous treatment 0.4 mass part of alumina particles was added to the prepared toner particles. Here, the alumina particles were those subjected to surface treatment by 1.25 mass % of dimethyl silicon, in which the number of adsorbed $CO_2$ gas was 3.3/$nm^2$, and a specific surface area measured by the BET method was 87 $m^2/g$. Then, the mixture was stirred by the Henschel mixer at the number of revolutions of 3000 rpm for 1 minute, and the alumina particles were adhered onto the surfaces of the toner particles, whereby the magenta toner M1 was prepared.

(2) Preparation of magenta toners M2 to M19

The magenta colorant dispersion MB1 used in the preparation of the magenta toner M1 was prepared for each of the magenta toners M2 to M19. The magenta toners M2 to M19 were prepared in a similar procedure to that of the preparation of the magenta toner M1 except for changing the magenta colorant dispersion to the magenta colorant dispersions MB2 to MB19 shown in. Table 3 described above.

(3) Preparation of magenta toner M20 (suspension polymerization method)

451 mass parts of 0.1 M-aqueous $Na_3PO_4$ solution were poured into 709 mass parts of ion exchange water, were heated to 60° C., and were thereafter stirred at 12000 rpm by using the TK-homomixer (made by Primix Corporation). To the mixture, 67.7 mass parts of 1.0 M-aqueous $CaCl_2$ solution was gradually added, whereby a dispersion medium containing $Ca_3(PO_4)$, was obtained.

Styrene: 170 mass parts 2-ethylhexyl acrylate: 30 mass parts

Paraffin wax: 60 mass parts

Compound A13: 2 mass parts

Compound B35: 5 mass parts

Styrene-methacrylic acid-methyl methacrylate copolymer (acid value: 70; Mw: 50000; Mw/Mn=2.0): 10 mass parts Di-tert-butylsalicylic acid metal compound: 3 mass parts Among the above-described compounds, 140 mass parts of 170 mass parts of the styrene were premixed by using the EbaraMilder (made by Ebara Corporation). All of the remaining compounds described above were mixed with this premixture, were heated to 60° C., and were dissolved and dispersed, whereby a monomer mixture was formed. Moreover, while maintaining the monomer mixture at 60° C., 5 mass parts of dimethyl-2,2'-azobisisobutylate was added as an initiator thereto, followed by dissolution, whereby a monomer composition was prepared.

Next, the above-described monomer composition was poured into the dispersion medium prepared as described above. The mixture was stirred at 10000 rpm for 20 minutes by using the TK-homomixer (made by Primix Corporation) maintained at 60° C. in a nitrogen atmosphere, whereby the monomer composition was granulated. Thereafter, reaction was caused for the mixture at 60° C. for 3 hours while stirring the mixture by a paddle stirrer, and the mixture was thereafter polymerized at 80° C. for 10 hours. After the end of the polymerization reaction, a reaction product was cooled, and $Ca_3(PO_4)_2$ was dissolved by being added with 5N hydrochloric acid, and was filtered, followed by rinsing and drying.

(4) Preparation of magenta toner M21 (pulverization method)

Polyester resin "NCP-001V" (made by Japan Carbide Industries Co., Ltd.): 100 mass parts Paraffin wax: 6 mass parts Compound A13: 2 mass parts Compound B35: 5 mass parts The above-described materials were mixed together by the Henschel mixer, were thereafter fused and kneaded by a biaxial extruder, and were cooled and solidified. Thereafter, the mixture was pulverized and classified by a jet mill and an air classifier. In such a way, toner particles in which the median diameter as the volume criterion was 6.5 μm were prepared.

Next, 0.4 weight % of alumina particles was added to the above-described toner particles. Here, the alumina particles were those subjected to surface treatment by a coupling treatment agent containing 1.25 weight % of dimethyl silicon and 2.5 weight % of $C_8F_{17}SO_2NC_2H_5(CH_2)_3Si(CH_3O)_3$, in which the number of adsorbed $CO_2$ gas was 3.3/nm$^2$, and a specific surface area measured by the BET method was 87 m$^2$/g. Then, the mixture was stirred by the Henschel mixer having a capacity of 10 liters at the number of revolutions of 3000 rpm for 1 minute, and the alumina particles were adhered onto the surfaces of the toner particles, whereby the magenta toner M21 was prepared.

3. Preparation of Magenta Toners L1 and L2 for Comparison

Magenta colorant dispersions LB1 and LB2 for comparison were prepared in a similar procedure to that of the preparation of the foregoing magenta colorant particle dispersion MB1 except for changing the type and loading of the compound as the colorant component of magenta to those shown in Table 3.

Moreover, magenta toners L1 and L2 for comparison were prepared in a similar procedure to that of the preparation of the foregoing magenta toner M1 except for using the magenta colorant dispersions LB1 and LB2 for comparison in place of the magenta colorant particle dispersion MB1.

4. Preparation of yellow toner Y

Yellow toner Y was prepared in a similar procedure to that of the preparation of the foregoing magenta colorant dispersion MB1 except for changing the compounds All and the compound B33, which were the magenta colorant components, to the following yellow colorant component.

C.I. Pigment Yellow 74: 25 mass parts

5. Preparation of cyan toner C

Cyan toner C was prepared in a similar procedure to that of the preparation of the foregoing magenta colorant dispersion MB1 except for changing the compounds A11 and the compound B33, which were the magenta colorant components, to a compound represented by the following formula (15). The compound represented by the following formula (15) is a cyan colorant component.

[Formula 12]

(15)

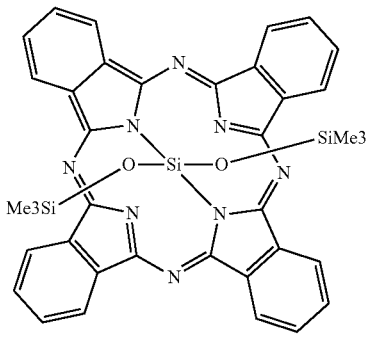

[Evaluation Test]

The respective magenta toners M1 to M21 were combined with the yellow toner Y and the cyan toner C, whereby Examples 1 to 21 were composed. The magenta toners L1 to L2 for comparison were combined with the yellow toner Y and the cyan toner C, whereby Comparative examples 1 and 2 were composed. Examples 1 to 21 and Comparative examples 1 and 2 were evaluated for the next respective evaluation items (1) to (4).

Note that, at the time of performing printing, a ferrite carrier with a volume average particle diameter of 60 μm, which was coated with silicon resin, was mixed with each of the magenta toners M1 to M21, L1 and L2, the yellow toner Y and the cyan toner C, and developers with a toner concentration of 6% were prepared and used.

(1) Reproducibility of flesh color

A photograph image in which "a woman who holds a baby" was taken by a digital camera was color-printed by using the respective toners (magenta toners, yellow toner, cyan toner) according to Examples 1 to 21 and Comparative examples 1 and 2. Impressions of the printed photographs when viewed from the front were evaluated by 10 panelists. As a comparison subject, a reference image was prepared, in which the same photograph image was printed by toner for DocuCentre-III C4400 (made by Fuji Xerox Co., Ltd.) by using DocuCentre-III C4400. Examples 1 to 21 and Comparative examples 1 and 2 were evaluated while being compared with this reference image.

Evaluation criteria are as follows.

◎: responders saying "the tone was great, and the image quality is high" are 8 or more persons among 10 persons ○: responders saying "both of the tone and the image quality are a little better" are 7 or more persons among 10 persons Δ: responders saying "both of the tone and the image quality are similar" are 6 or more persons among 10 persons ×: responders saying "both of the tone and the image quality are somewhat poor" are 7 or more persons among 10 persons (2) Reproducibility of blue violet Patch image of blue violet-based color codes of 7 colors were outputted to and displayed on a computer display. Meanwhile, color printing was performed by using the respective toners (magenta toners, yellow toner, cyan toner) according to Examples 1 to 21 and Comparative examples 1 and 2, and printed matters corresponding to the patch image were made. It was determined whether or not a tone of each patch image on each printed matter thus made was identifiable as a color of each color code displayed on the display. Conditions of the computer used for the display are as follows.

Computer: iMAC (made by Apple Computer, Inc.)
Display: 24-inch wide liquid crystal display screen
Resolution of display: 1920×1200 pixels
2.16 GHz Intel Core 2 Duo processor I
4 MB-shared L2 cashe
SO-SIMM, 1 GB (512MB×2)
Serial ATA hard drive 2, 250GB
8×Dual-Layer SuperDrive (DVD+R, DL, DVD±RW, CD-RW)
NVIDIA GeForce 7300 GT 128MB GDDR3 memory
Built-in AirMac Extreme and Bluetooth 2.0
Apple Remote The blue violet-based color codes of 7 colors, which were used for the evaluation, are #7f00ff, #7700ef, #7000e0, #6800d1, #6000c1, #5900b2 and #5100a3.

Evaluation criteria are as follows.

◎: all of 7 colors were identifiable (excellent)

○: 5 colors or more to less than 7 colors were identifiable (good)

×: only less than four colors were identifiable (poor)

◎ and ○ were determined to be acceptable.

(3) Density stability evaluation 1

Solid images (images fully painted with a high density) were color-printed by using the respective toners (magenta toners, yellow toner, cyan toner) according to Examples 1 to 21 and Comparative examples 1 and 2. The color printing was continuously performed for 50,000 sheets, and a density variation between the beginning time of the printing and the time after the printing for 50,000 sheets was ended was measured. With regard to the measurement, a density of each solid image was measured five times by using a color reflection densitometer (for example, X-RITE404A, made by X-Rite Co.), and an average value of such measurement values was adopted as a density value. A measured density value at the beginning time of the printing was 1.40. A difference A Δ between this density at the beginning time of the printing and the density value after the printing for 50,000 sheets was obtained.

Evaluation criteria are as follows.

a: good (Δ<0.08)
b: average (0.08≦Δ<0.15)
c: little poor (0.15≦Δ<0.20)
d: poor (0.20≦Δ)

(4) Density stability evaluation 2

Halftone images (images painted with a middle density) were color-printed by using the respective toners (magenta toners, yellow toner, cyan toner) according to Examples 1 to 21 and Comparative examples 1 and 2. The color printing was continuously performed for 50,000 sheets, and a density variation between the beginning time of the printing and the time after the printing for 50,000 sheets was ended was measured. With regard to the measurement, a density of each halftone image was measured five times by using the color reflection densitometer (for example, X-RITE404A, made by X-Rite Co.), and an average value of such measurement values was adopted as a density value. A measured density value at the beginning time of the printing was 1.40. A difference A (%) between this density at the beginning time of the printing and the density value after the printing for 50,000 sheets was obtained.

Evaluation criteria are as follows.

a: good (Δ<0.03)
b: average (0.03≦Δ<0.05)
c: little poor (0.05≦Δ<0.08)
d: poor (0.08≦Δ)

Evaluation results are shown in Table 4.

TABLE 4

| | MAGENTA TONER | YELLOW TONER | CYAN TONER | REPRODUCIBILITY OF FLESH COLOR | REPRODUCIBILITY OF BLUE | DENSITY STABILITY 1 | DENSITY STABILITY 2 | PRODUCTION METHOD |
|---|---|---|---|---|---|---|---|---|
| EXAMPLE 1 | M1 | Y | C | ◎ | ○ | a | b | CORE/SHELL METHOD |
| EXAMPLE 2 | M2 | Y | C | ◎ | ○ | a | b | CORE/SHELL METHOD |
| EXAMPLE 3 | M3 | Y | C | ◎ | ◎ | a | a | CORE/SHELL METHOD |
| EXAMPLE 4 | M4 | Y | C | ◎ | ○ | a | b | CORE/SHELL METHOD |
| EXAMPLE 5 | M5 | Y | C | ○ | ○ | a | b | CORE/SHELL METHOD |
| EXAMPLE 6 | M6 | Y | C | ◎ | ○ | a | b | CORE/SHELL METHOD |
| EXAMPLE 7 | M7 | Y | C | ○ | ◎ | a | b | CORE/SHELL METHOD |
| EXAMPLE 8 | M8 | Y | C | ◎ | ○ | a | b | CORE/SHELL METHOD |
| EXAMPLE 9 | M9 | Y | C | ◎ | ◎ | a | a | CORE/SHELL METHOD |

TABLE 4-continued

| | MAGENTA TONER | YELLOW TONER | CYAN TONER | REPRODUC-IBILITY OF FLESH COLOR | REPRODUC-IBILITY OF BLUE | DENSITY STABILITY 1 | DENSITY STABILITY 2 | PRODUCTION METHOD |
|---|---|---|---|---|---|---|---|---|
| EXAMPLE 10 | M10 | Y | C | ○ | ◎ | a | b | CORE/SHELL METHOD |
| EXAMPLE 11 | M11 | Y | C | ○ | ◎ | a | b | CORE/SHELL METHOD |
| EXAMPLE 12 | M12 | Y | C | ○ | ○ | b | b | CORE/SHELL METHOD |
| EXAMPLE 13 | M13 | Y | C | ○ | ○ | b | b | CORE/SHELL METHOD |
| EXAMPLE 14 | M14 | Y | C | ○ | ○ | b | b | CORE/SHELL METHOD |
| EXAMPLE 15 | M15 | Y | C | ○ | ○ | b | b | CORE/SHELL METHOD |
| EXAMPLE 16 | M16 | Y | C | ○ | ○ | b | b | CORE/SHELL METHOD |
| EXAMPLE 17 | M17 | Y | C | ○ | ○ | b | b | CORE/SHELL METHOD |
| EXAMPLE 18 | M18 | Y | C | ○ | ○ | b | b | CORE/SHELL METHOD |
| EXAMPLE 19 | M19 | Y | C | ○ | ○ | b | c | CORE/SHELL METHOD |
| EXAMPLE 20 | M20 | Y | C | ◎ | ◎ | a | b | SUSPENSION POLYMERIZATION METHOD |
| EXAMPLE 21 | M21 | Y | C | ◎ | ◎ | a | b | PULVERIZATION METHOD |
| COMPARATIVE EXAMPLE 1 | L1 | Y | C | Δ | X | c | d | CORE/SHELL METHOD |
| COMPARATIVE EXAMPLE 2 | L2 | Y | C | X | X | c | c | CORE/SHELL METHOD |

As shown in Table 4, in Examples 1 to 21 in each of which the magenta toner according to present invention is used, the reproducibility of the flesh color is good. In particular, with regard to the blue, there are many color codes which coincide with those according to the RGB display, and it is understood that the color gamut is expanded and it becomes possible to reproduce the color faithful to the display in comparison with Comparative examples 1 and 2.

Moreover, it is understood that, while the durability against the printing for 50,000 sheets is poor and the density variations occur in Comparative examples 1 and 2, the density variations are small and stabilized in both of the solid images and the halftone images in Examples 1 to 21.

Industrial Applicability

The toner according to the present invention is applicable as the toner for use in the development in the printing of the electrophotographic method.

Although various exemplary embodiments have been shown and described, the invention is not limited to the embodiments shown. Therefore, the scope of the invention is intended to be limited solely by the scope of the claims that follow.

The invention claimed is:

1. A toner comprising at least a resin and a colorant, wherein the colorant comprises a compound represented by a following general formula (1) and a compound represented by a following general formula (2), wherein the general formula (1) is:

[Formula 1]

(1)

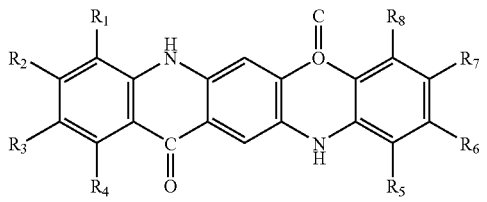

where $R_1$ to $R_8$ respectively denote any one of a hydrogen atom, a halogen atom, an alkyl group, and an alkyl group including a fluorine atom; and where at least one of $R_1$ to $R_8$ denotes a chlorine atom, and wherein the general formula (2) is:

[Formula 2]

(2)

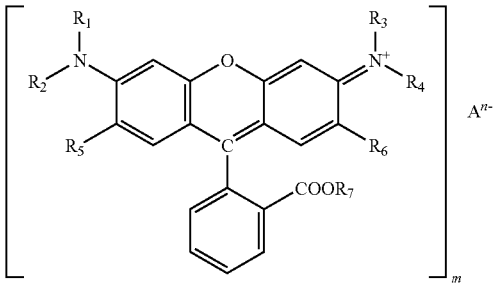

where $R_1$ to $R_4$ respectively denote a hydrogen atom, or an alkyl group having 1 to 4 carbon atoms; $R_5$ and $R_6$ respectively denote a hydrogen atom, or an alkyl group having 1 to 2 carbon atoms; $R_7$ denotes a hydrogen atom, or an alkyl group having 1 to 4 carbon atoms; m denotes the number of 1 or 2; $A^{n-}$ denotes a chlorine ion or a sulfonic acid compound ion; and n denotes the number of 1 or 2.

2. The toner as claimed in claim 1, wherein in the compound represented by the general formula (1), at least one of $R_1$ to $R_4$ is a chlorine atom, and at least one of $R_5$ to $R_8$ is a chlorine atom.

3. The toner as claimed in claim 1, wherein the compound represented by the general formula (2) is subjected to a lake conversion by a lake species.

4. The toner as claimed in claim 1, wherein the compound represented by the general formula (1) is included by a ratio of 20 to 100 mass parts with respect to 100 mass parts of the compound represented by the general formula (2).

* * * * *